United States Patent [19]

Smith

[11] 4,386,907

[45] Jun. 7, 1983

[54] LADLE HEATER WITH STOPPER ROD OPENING

[75] Inventor: Daniel B. Smith, Gainesville, Ga.

[73] Assignee: The Cadre Corporation, Atlanta, Ga.

[21] Appl. No.: 297,640

[22] Filed: Aug. 31, 1981

[51] Int. Cl.[3] ..... F23C 7/06

[52] U.S. Cl. ..... 432/225; 266/155; 266/236

[58] Field of Search ..... 266/44, 236, 240; 432/224, 225

[56] References Cited

U.S. PATENT DOCUMENTS

| | | | |
|---|---|---|---|
| 792,642 | 6/1905 | Williams . | |
| 1,675,735 | 7/1928 | Stohr . | |
| 2,294,168 | 8/1942 | Francis et al. . | |
| 3,148,272 | 9/1964 | Aitken et al. . | |
| 4,001,996 | 1/1977 | Byrd, Jr. . | |
| 4,090,054 | 5/1978 | Heine et al. | 266/240 |
| 4,106,755 | 6/1978 | Dell | 266/44 |
| 4,190,235 | 4/1980 | Dell | 266/44 |
| 4,223,873 | 1/1980 | Battles . | |
| 4,229,211 | 11/1980 | Battles . | |

FOREIGN PATENT DOCUMENTS

| | | | |
|---|---|---|---|
| 463090 | 7/1928 | Fed. Rep. of Germany . | |
| 464328 | 8/1928 | Fed. Rep. of Germany . | |
| 2377595 | 8/1978 | France . | |
| 375924 | 9/1975 | Sweden . | |
| 408276 | 3/1976 | Sweden . | |
| 408277 | 4/1977 | Sweden . | |
| 946319 | 1/1964 | United Kingdom | 432/224 |

*Primary Examiner*—M. J. Andrews

*Attorney, Agent, or Firm*—Thomas & Kennedy

[57] ABSTRACT

The lid of a ladle heater includes a valve gate rod opening so that the ladle can move toward and away from engagement with the rim of the ladle about a valve gate rod. Cylindrical plug elements are supported between the lid of the ladle heater and the ladle and move apart to straddle the stopper rod, and as the lid moves toward engagement with the rim of the ladle the cylindrical plugs engage the ladle rim as the lid continues its movement, thus resulting in the cylindrical plugs moving into and closing the stopper rod opening.

10 Claims, 8 Drawing Figures

LADLE HEATER WITH STOPPER ROD OPENING

BACKGROUND OF THE INVENTION

This invention relates to a ladle heating system wherein a lid is applied to the rim of the open top of a ladle, a flame is directed from the lid into the chamber of the ladle and the hot gases are exhausted from the ladle back through the lid. More particularly, the invention relates to a ladle heater for heating a ladle of the type that includes a gate valve in its lower portion and a rod that extends upwardly from the gate valve through the open top of the ladle.

In the molten metals industry, ladles and similar metal receivers such as tundishes and torpedo cars receive a charge of molten metal and transport the molten metal to a casting machine, etc. The receivers usually are lined with a refractory material, and it is desirable to preheat the receiver before molten metal is received therein in order to avoid interface solidification of the metal upon contact between the metal and the interior surface of the receiver, and also to avoid thermal shock to the refractory liner of the receiver and the resulting deterioration of the liner. A preheated ladle also minimizes the heat loss from the molten metal as the metal is transported in the ladle from the furnace to the pouring position, thereby assisting in maintaining the molten metal at a high enough temperature for use in a casting machine or a mold.

A common prior art method for heating ladles and other molten metal receivers prior to charging them with molten metal was to direct an open natural gas flame into the vessel. The open flame heating method permitted combustion gases from within the ladle vessel to escape to the surrounding atmosphere, thus permitting a substantial amount of the heat energy to escape without effective use thereof.

More recently, ladle heaters have been developed which tend to reduce the amount of heat that is permitted to escape to the surrounding atmosphere. For example, U.S. Pat. No. 4,229,211 discloses a ladle heating system wherein a seal is applied to the rim of the ladle and the air/gas stream is preheated in a heat exchanger by the gases exhausted from the ladle through the lid.

While the structure of the above-noted patent is effective in conserving energy during the preheating of ladles, the system does not provide a means for preheating ladles of the type that have a slide gate at the bottom and a stopper rod that extends upwardly from the slide gate through the open upper portion of the ladle. The presence of the stopper rod prevents the prior art lid assemblies from moving into sealing engagement with respect to the rim of the ladle.

SUMMARY OF THE INVENTION

Briefly described, the present invention comprises an improved system for preheating ladles of the type which include an open top vessel with a rim extending about the open top and a valve with a valve gate at its lower portion and a rod extending upwardly from the valve gate through the open top of the vessel. The lid assembly defines an opening therethrough for the passage of the stopper rod of the ladle, and the lid assembly includes a layer of compressible refractory fiber material of a breadth sufficient to span across the open top of the vessel for sealing engagement with the rim of the vessel. Plug elements are movably suspended by the lid assembly through the stopper rod opening below the lid assembly and straddle the stopper rod of the ladle and are movable into closed relationship about the stopper rod and the stopper rod opening of the lid assembly.

The stopper rod opening in the lid assembly opens through an edge of the lid assembly and overlies the rim of the ladle, and the plug elements comprise cylindrical rolls that are suspended beneath the lid assembly on opposite sides of the stopper rod, and as the lid assembly moves down toward engagement with the rim of the ladle, the cylindrical rolls engage the rim of the ladle first and stop their downward movement while the lid continues its downward movement, thus resulting in the cylindrical rolls being wedged into the stopper rod opening of the lid about the stopper rod. This tends to form a seal between the lid and the stopper rod.

Thus, it is an object of this invention to provide a heating system which efficiently heats ladles of the type that include stopper rods or other protruding elements that extend upwardly from within the ladle through the open top of the ladle.

Another object of this invention is to provide apparatus for heating open top ladles of the type that include stopper rods or other protruding elements from the open top of the ladle, by applying a seal to the rim of the ladle and forming a seal about the stopper rod.

Other objects, features and advantages of the present invention will become apparent upon reading the following specification, when taken in conjunction with the accompanying drawings.

DETAILED DESCRIPTION

Figure 1:
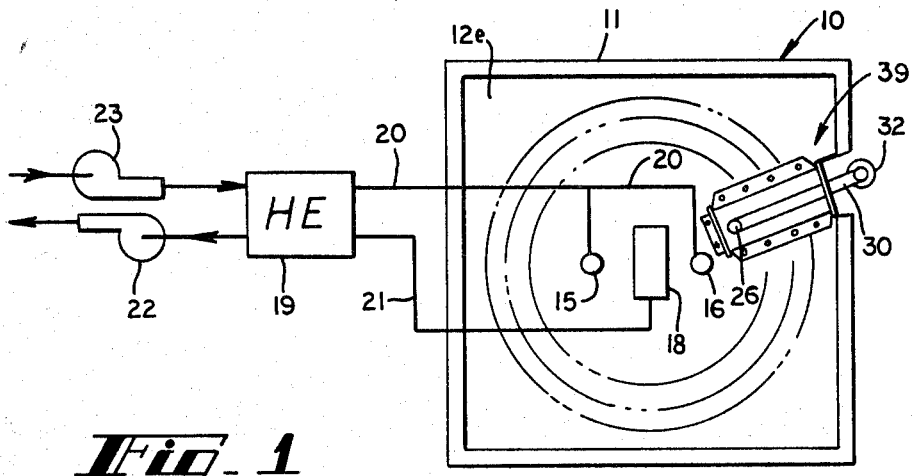
FIG. 1 is a schematic plan view of the upper surface of the lid assembly, showing the heat exchanger and blowers in schematic form.
Figure 2:
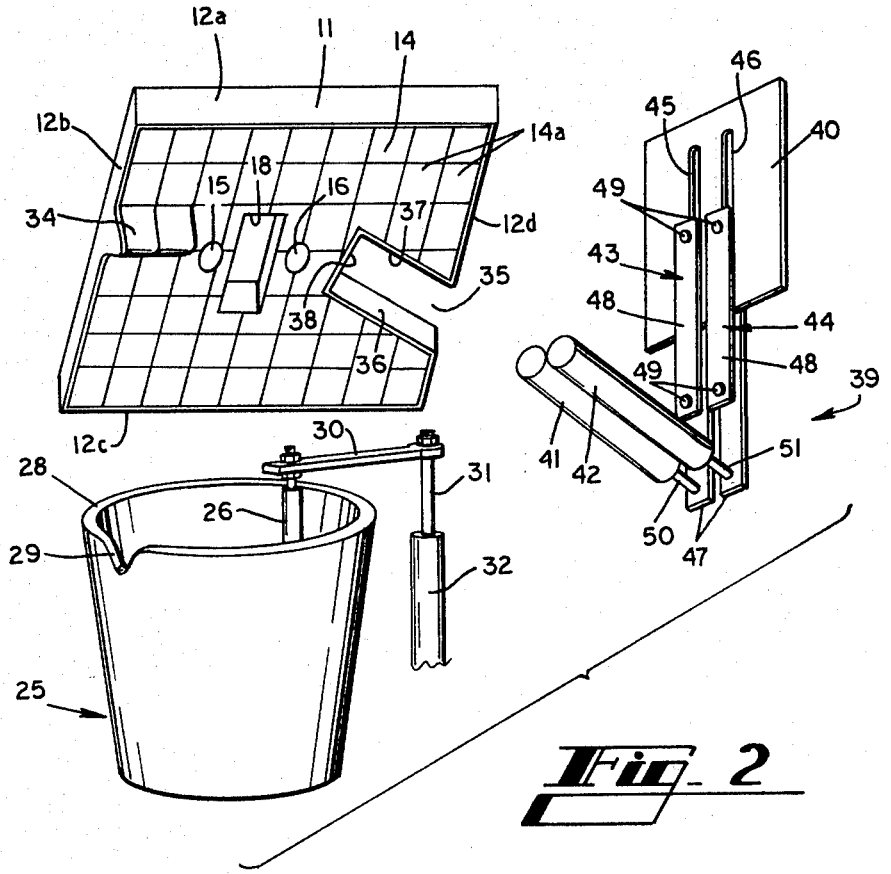
FIG. 2 is a perspective illustration of a ladle having a stopper rod protruding therefrom, the lid assembly tilted away from the ladle, and the stopper rod plugs shown in exploded view from the lid assembly.

Referring now in more detail to the drawings, in which like numerals indicate like parts throughout the several views, FIG. 1 illustrates the top surface of a lid assembly 10 that is to be used in combination with apparatus for heating ladles. The lid assembly includes a support frame 11 which is approximately rectangular and as illustrated in FIG. 2 includes peripheral side walls 12*a*, 12*b*, 12*c* and 12*d* and a back wall 12*e*, and a layer of compressible refractory fiber material 14 is supported by the support frame. The fiber material 14 can be formed in various configurations, but preferably is formed so as to provide at least one foot of thickness and so as to be compressible. A suitable form for the fiber material 14 is illustrated in U.S. Pat. No. 4,001,996, wherein the fiber material is formed in a web or blanket of refractory fibers and the webs are formed in elongated sheets. The sheets are folded in a zig-zag or an accordion arrangement so as to include a series of layers with exposed side edges on opposite sides and with folds exposed on the other side surfaces so as to form a rectangular accordion folded block. A plurality of the blocks 14*a* are mounted in the support frame 11 in a tightly packed configuration so that the blocks are maintained in compression across the breadth of the support frame 11. A similar such lid construction is disclosed in more detail in U.S. Pat. No. 4,229,211.

Burners 15 and 16 extend through lid assembly 10, and open through the fiber material 14 of the lid assembly, and exhaust gas opening 18 extends through the lid assembly and also opens through the layer of fiber material 14. Heat exchanger 19 is mounted adjacent lid assembly 10, and air supply conduits 20 communicate between heat exchanger 19 and burners 15 and 16 while air exhaust conduit 21 communicates between exhaust gas opening 18 and heat exchanger 19. One or more blowers, such as blowers 22 and 23, induce a flow of air through the heat exchanger 19 to the lid assembly 10, and then back from the lid assembly through the heat exchanger.

Lid assembly 10 is constructed so as to engage and seal against a ladle 25 of the type that includes a slide gate valve (not shown) in its lower portion, with a slide gate valve operating rod 26 that extends upwardly from the valve through the open top of the ladle. The ladle is an open top vessel that includes an upper rim 28 that, in some cases, includes a recessed pouring spout 29. A cross bar 30 is connected at one of its ends to valve gate rod 26 and extends across the rim of the ladle, and the other end of the cross bar 30 is connected to the rod 31 of a cylinder 32. Cylinder 32 is arranged to raise and lower valve gate rod 26. This is conventional in the art.

The layer of compressible refractory fiber material 14 of lid assembly 10 includes a protrusion 34 that is sized and shaped to fit into and form a seal with respect to the recessed pouring spout 29 of the ladle. The protrusion is formed from a special folding of the layers of material of one or more of the fiber blocks 14*a*.

Figure 6:
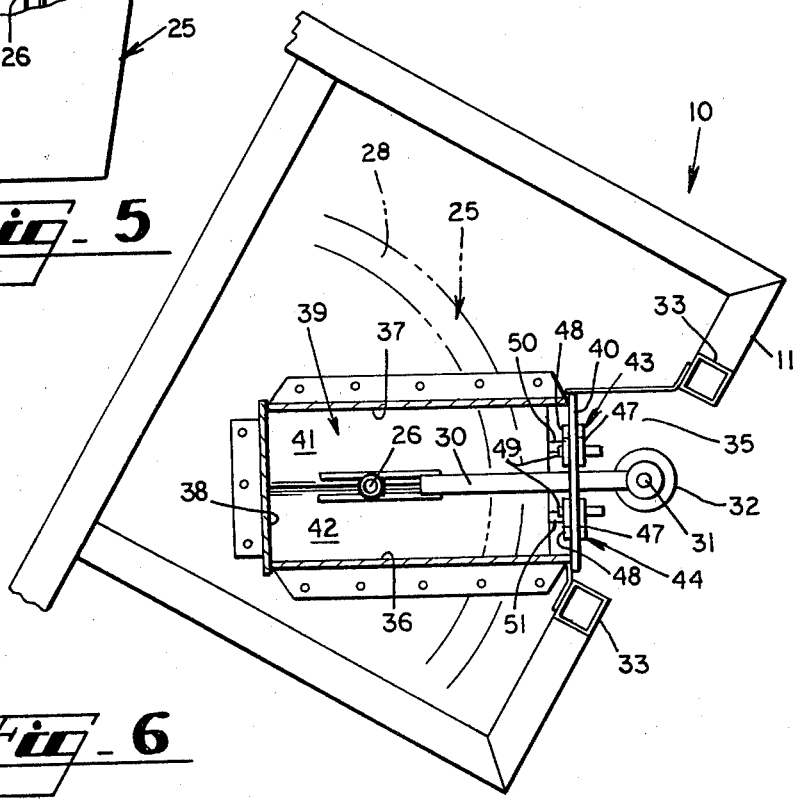
FIG. 6 is a top view of a portion of the lid assembly, which illustrates the stopper rod opening in the lid assembly.

An opening 35 (FIGS. 2, 6 and 7) is formed through the lid assembly 10. Opening 35 comprises a slot extending inwardly from the edge of the lid assembly, and the slot is sized and shaped to fit about valve gate rod 26 and cross bar 30. The opposed side surfaces 36 and 37 (FIG. 8) of the opening as well as the end surface 38 (FIG. 7) are angled and diverge downwardly and outwardly. When the lid assembly is applied to the rim 28 of ladle 25, the lid assembly is of a breadth sufficient to span across the open upper portion of the ladle, and the fiber material 14 of the lid assembly presses against the rim 28 to seal against the rim and the opening 35 straddles the valve gate rod 26 and cross bar 30, so that the movement of the lid downwardly against the rim is not obstructed by the valve gate rod. The opening 35 of the lid assembly 10 extends across the rim 28 of the ladle (FIGS. 1, 6 and 7).

Figure 8:
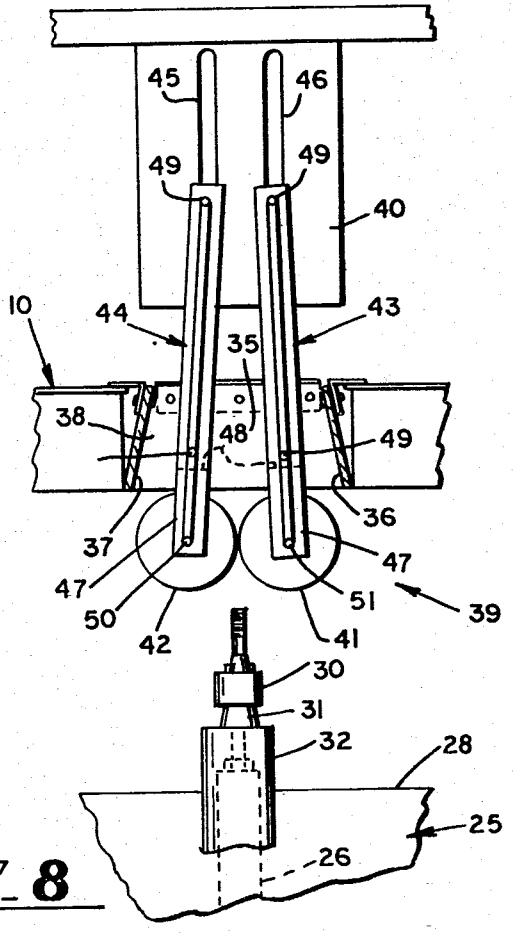
FIG. 8 is an end detail illustration of the portion of the lid assembly illustrated in FIG. 6.
Figure 7:
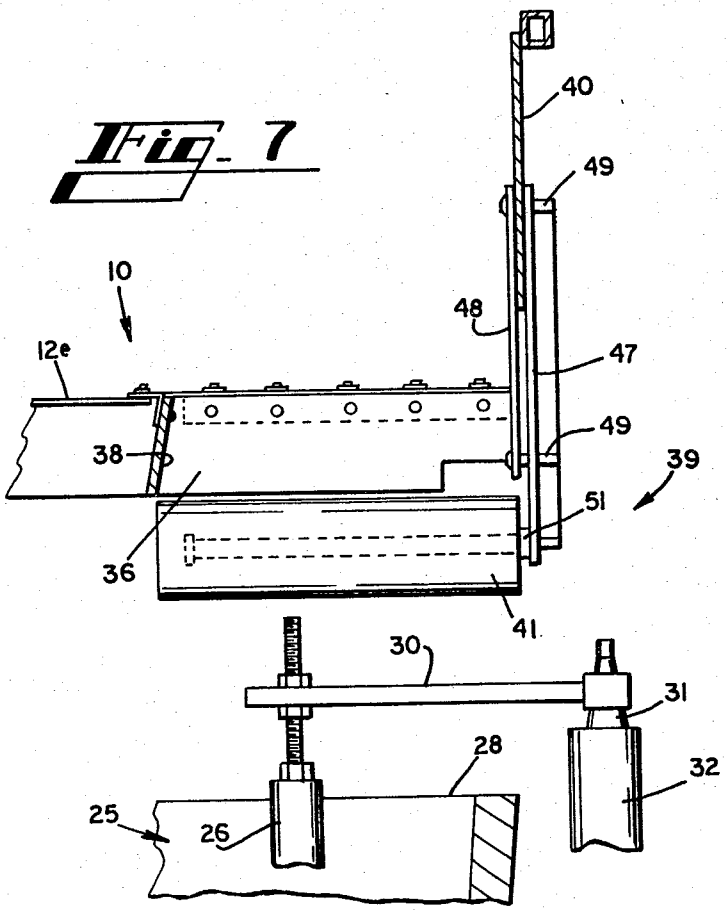
FIG. 7 is a side detail illustration of the portion of the lid assembly shown in FIG. 6.

As illustrated in FIGS. 2, 7 and 8, plug means 39 is mounted on lid assembly 10 and includes a plug support plate 40 mounted by suitable support framework 33 in vertically spaced relationship over lid assembly 10, and a pair of plug elements 41 and 42 are suspended from plug support plate 40 by support arm assemblies 43 and 44. Plug elements 41 and 42 are formed from compressible refractory fiber material, are cylindrically shaped, and are supported in a horizontal attitude by plug support plate 40 at a position beneath lid assembly 10.

As illustrated in FIG. 8, plug support plate 40 comprises a pair of spaced, parallel vertical slots 45 and 46, and support arm assemblies 43 and 44 each include a support arm 47 (FIG. 7) and a stabilizing arm 48 which are spaced apart from each other by connecting pins 49. Support arms 47 are positioned on one side of plug support plate 40 while the stabilizing arms 48 are positioned on the opposite side of plug support plate 40, with the upper pins 49 extending through the vertical slots 45 and 46 of the plug support plate.

The plug elements 41 and 42 are mounted on horizontal support rods 50 and 51 which are rigidly connected to the lower end portions of support arms 47 of the support arm assemblies 43 and 44. The arrangement is such that the plug elements 41 and 42 are freely suspended from plug support plate 40 beneath lid assembly 10 and are in alignment with and below the opening 35 of the lid assembly. This causes the plug elements 41 and 42 usually to be in overlying relationship with the rim 28 of the ladle 25 below the lid assembly 10.

Figure 3:
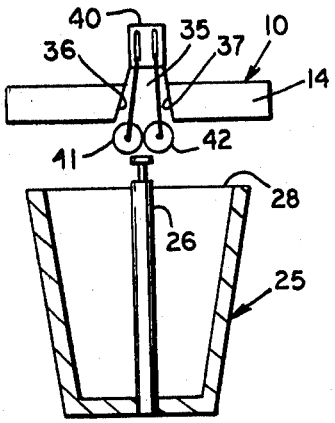
FIGS. 3, 4 and 5 are progressive schematic side cross-sectional views of a ladle with a stopper rod and the lid assembly, illustrating the movements of the cylindrical plugs as the lid assembly is lowered onto the upper rim of the ladle.
Figure 4:
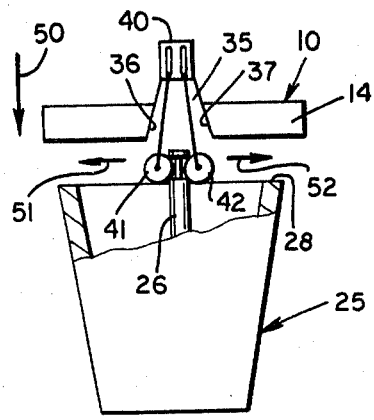
Figure 5:
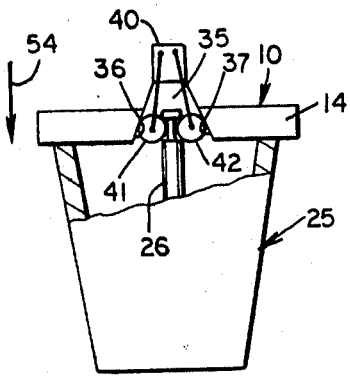

As illustrated in schematic form in FIGS. 3, 4 and 5, the plug elements 41 and 42 are located over the upper end portion of valve gate rod 26, and as the lid assembly 10 is lowered as indicated by arrow 50, the plug elements 41 and 42 engage the upper portion of valve gate rod 26 and tend to spread apart from each other and pass about cross bar 30 and straddle the valve gate rod as indicated by arrows 51 and 52. As the lid assembly moves further downwardly as indicated by arrow 54, the plug elements 41 and 42 engage the rim 28 of the ladle 25 and stop their downward movement, but the lid assembly continues to move downwardly until its layer of compressible refractory fiber material 14 engages the rim of the ladle. This further movement of the lid assembly causes the rod opening 35 through the lid assembly to move downwardly about the plug elements 41 and 42. The downwardly diverging side walls 36 and 37 (FIG. 8) tend to wedge about plug elements 41 and 42, urging the plug elements toward each other and in tightly straddled relationship about valve gate rod 26. The downwardly diverging end wall 38 (FIG. 7) tends to contact and compress the end portions of the plug elements. This tends to cause the plug elements 41 and 42 to fill the valve gate rod opening 35, forming a seal between the lid assembly 10 and the valve gate rod 26 and forming a seal at the rim of the ladle. When the plug elements 41 and 42 terminate their downward movement when they engage the rim 28 of a ladle 25, and as the lid assembly 10 continues its further downward movement, the upper end portions of the support arm assemblies 43 and 44 of the plug elements tend to ride up through the slots 45 and 46 of plug support plate 40. Thus, the plug elements 41 and 42 are suspended with a lost motion arrangement with respect to the plug support plate 40, and the plug elements are movable laterally to a limited extent which is sufficient for the plug elements to receive the valve gate rod 26 therebetween.

When the lid assembly 10 is to be raised away from the ladle 25, the plug elements 41 and 42 tend to remain straddled about the valve gate rod 26 until the lid assembly has been lifted away from the ladle and the wedging effect of the sloped side walls 36 and 37 of the valve gate rod opening 35 has been removed from the plug elements 41 and 42 and until the support arm assemblies 43 and 44 have reached the lower ends of slots 45 and 46 of plug support plate 40, whereupon further upward movement of the lid assembly lifts the plug elements 41 and 42 away from the ladle 25.

While this invention has been described in detail with particular reference to a preferred embodiment thereof, it will be understood that variations and modifications can be effected within the spirit and scope of the invention as described hereinbefore and as defined in the appended claims.

I claim:

1. Apparatus for heating ladles of the type which include an open top vessel with a rim extending about its open top and a valve with a valve gate at its lower portion and a rod extending upwardly from the valve gate through the open top of the vessel, said apparatus comprising a lid assembly for placement against the rim of the open top of the vessel, said lid assembly including a support frame and a layer of compressible refractory fiber material supported by said support frame and forming a lid surface of a breadth sufficient to span across and to close the open top of the vessel for sealing engagement with the rim of the vessel, a rod opening through said lid assembly for telescopically receiving the rod of the ladle, and plug means for closing the opening of the lid assembly about the rod of the ladle.

2. The apparatus of claim 1 and wherein said plug means comprise a pair of plug elements formed from compressible refractory fiber material, support means for supporting said plug elements on opposite sides of the rod of the ladle such that said plug elements are movable toward and away from each other and are movable along the length of the rod of the ladle toward and away from said rod opening of said lid assembly.

3. The apparatus of claim 2 and wherein said rod opening of said lid assembly is approximately rectangular, and wherein said plug elements are approximately cylindrical and fit into said rod opening.

4. The apparatus of claim 2 and wherein said support means supports said plug elements adjacent said lid surface in overlying relationship with the rim of the ladle so that as the lid surface of said lid assembly is applied to the rim of the ladle the plug elements engage the rim of the ladle and are urged by the rim toward the rod opening of the lid assembly.

5. The apparatus of claim 1 and wherein further including a burner carried by said lid assembly for directing a flame of fuel and gas from said lid assembly into the ladle, a gas outlet opening formed through said lid assembly, and a heat exchanger in communication with said burner and said gas outlet opening whereby heat of the gas moving from the ladle through the gas outlet opening of the lid assembly is transferred to the gas moving to the burner.

6. Apparatus for heating ladles of the type which include an open top vessel with a rim extending about the open top and a valve with a valve gate at its lower portion and a rod extending upwardly from the valve gate through the open top of the vessel, said apparatus comprising a lid assembly for closing the open top of the ladle, said lid assembly comprising a support frame, a layer of heat insulator material supported by said lid assembly of a breadth sufficient to engage the rim of the ladle and to close the ladle, a burner mounted to said lid assembly and communicating through said heat insulator material for directing a flame from said lid assembly downwardly into the ladle, a gas outlet opening defined by said heat insulator material for exhausting hot gas from the ladle, and a valve gate rod opening defined by said heat insulator material for placement about the valve gate rod, plug means comprising a pair of plug elements for straddling the valve gate rod and for closing the valve gate rod opening about the valve gate rod, plug support means carried by said lid assembly and extending downwardly through said valve gate rod opening and movably supporting said plug elements below said heat insulator material.

7. The apparatus of claim 6 and wherein said valve gate rod opening comprises an elongated slot opening through an edge of said lid assembly, and wherein said plug elements each comprise a cylindrically-shaped mass of compressible insulator material and both extending parallel to said elongated slot and movable into side-by-side relationship about the valve gate rod and into said slot to close said slot.

8. The apparatus of claim 6 and wherein said plug support means includes means for suspending said plug elements over the rim of the ladle opening whereby as the lid assembly is lowered toward engagement with the rim of the ladle opening the plug elements engage the rim of the ladle and the valve gate rod opening of the lid assembly moves downwardly about the plug elements.

9. The apparatus of claim 6 and wherein said layer of heat insulator material supported by said lid assembly comprises compressible refractory fiber material for sealing engagement with the rim of the ladle.

10. The apparatus of claim 6 and wherein said valve gate rod opening includes opposed downwardly diverging surfaces, and wherein said plug support means suspends said plug element below said insulator material in telescoping relationship with said valve gate rod opening so that when the plug elements are moved upwardly with respect to the lid assembly the surfaces of the valve gate rod opening urge the plug elements toward sealing engagement with each other about the valve gate rod.

* * * * *